US008701293B2

(12) United States Patent
Sullivan

(10) Patent No.: US 8,701,293 B2
(45) Date of Patent: Apr. 22, 2014

(54) UTILITY KNIFE

(76) Inventor: Scott L. Sullivan, San Francisco, CA (US)

( * ) Notice: Subject to any disclaimer, the term of this patent is extended or adjusted under 35 U.S.C. 154(b) by 211 days.

(21) Appl. No.: 12/904,631

(22) Filed: Oct. 14, 2010

(65) Prior Publication Data

US 2011/0083326 A1 Apr. 14, 2011

Related U.S. Application Data

(60) Provisional application No. 61/279,076, filed on Oct. 14, 2009.

(51) Int. Cl.
*F41B 13/02* (2006.01)

(52) U.S. Cl.
USPC ..... 30/151; 30/162; 30/337

(58) Field of Classification Search
USPC ..... 30/162, 163, 335, 153, 160, 161, 151, 30/152, 337, 338, 339
See application file for complete search history.

(56) References Cited

U.S. PATENT DOCUMENTS

| | | | | | |
|---|---|---|---|---|---|
| 2,569,080 | A * | 9/1951 | Trimble et al. | ..... | 30/320 |
| 3,448,518 | A * | 6/1969 | Sklar | ..... | 30/162 |
| 3,660,896 | A * | 5/1972 | Umholtz | ..... | 30/162 |
| 4,277,888 | A * | 7/1981 | Szabo | ..... | 30/162 |
| 5,545,175 | A * | 8/1996 | Abidin et al. | ..... | 606/182 |
| 5,569,282 | A * | 10/1996 | Werner | ..... | 606/167 |
| 5,779,724 | A * | 7/1998 | Werner | ..... | 606/167 |
| 6,349,473 | B1 * | 2/2002 | Schmidt | ..... | 30/162 |
| 6,637,112 | B2 * | 10/2003 | Davis | ..... | 30/2 |
| 6,848,185 | B2 * | 2/2005 | Tebo | ..... | 30/162 |
| 6,957,491 | B2 * | 10/2005 | Van Deursen et al. | ..... | 30/142 |
| 7,101,382 | B2 * | 9/2006 | George et al. | ..... | 606/167 |
| 7,185,435 | B1 * | 3/2007 | Tseng | ..... | 30/152 |
| 7,533,467 | B2 * | 5/2009 | Fossella | ..... | 30/162 |
| 2003/0079347 | A1 * | 5/2003 | Davis | ..... | 30/2 |
| 2004/0139614 | A1 * | 7/2004 | Tebo | ..... | 30/162 |
| 2005/0144787 | A1 * | 7/2005 | Macri | ..... | 30/142 |
| 2009/0094840 | A1 * | 4/2009 | Kanemoto et al. | ..... | 30/162 |
| 2009/0178283 | A1 * | 7/2009 | Wu | ..... | 30/162 |
| 2009/0223062 | A1 * | 9/2009 | Tucker | ..... | 30/162 |
| 2009/0235533 | A1 * | 9/2009 | Huang | ..... | 30/143 |
| 2010/0281696 | A1 * | 11/2010 | Hao et al. | ..... | 30/152 |

* cited by examiner

*Primary Examiner* — Omar Flores Sanchez
(74) *Attorney, Agent, or Firm* — Fish & Richardson P.C.

(57) ABSTRACT

A utility knife includes an elongaged handle having an internal cavity, two opposing ends and a side having at least one locking opening. A shuttle is sized to slide within the cavity and has a side surface. The shuttle has a spring-loaded locking button projecting from the side surface and into the handle. The button is sized and shaped to selectively project into the at least one locking opening. The shuttle is bonded to a conventionally shaped utility knife blade of the type which includes two opposing cutting regions. The shuttle can slide within the handle between the two opposing ends so that both cutting regions of the blade can be easily used as necessary. This utility knife is meant to be lost cost and disposable, but offers the user TWO cutting edges, doubling its effective use.

7 Claims, 31 Drawing Sheets

UTILITY KNIFE

CLAIM FOR PRIORITY

Applicant hereby claims priority to US provisional patent application entitled "Utility Knife", Ser. No. 61/279,076, filed Oct. 14, 2009, the entire application of which is hereby incorporated by reference.

BACKGROUND OF THE INVENTION

1) Field of the Invention

The present invention generally relates to cutting devices of the type commonly referred to as utility knives and more particularly, to improvements to such knives.

2) Discussion of Related Art

So-called utility knives have been around for several decades. Each are usually simple in construction usually including a handle, a slidable blade holder and a trapezoidal blade. The trapezoidal blade is conventional and includes a long sharpened edge and two sides that form an acute angle with respect to the sharpened edge and a top edge that includes locking notches. This blade fits snugly within the blade holder and the blade holder fits within the handle. The conventional handle is usually made up of two halves that may lock together and further includes a slot through which a portion of the blade holder may pass (in the form of a finger purchase) and provide access to the user so that the user may selectively slide the blade holder as desired within a restricted range of displacement. The blade may selectively be displaced between a fully retracted position wherein the blade is safely positioned within the housing and a fully extended position wherein one side of the trapezoidal blade protrudes from the handle so that useful cutting work may be performed.

Although the blades of such conventional utility knives can be replaced as required, there is a growing demand to provide simple, safe and easy to use disposable utility knives that can be used and then thrown away when the blade becomes dull. In some cases, these disposable utility knives may require automatically activated covers or shields that move to cover and protect the otherwise exposed sharpened edge when the blade is not being used to cut, yet remains on "standby" with the blade protruding from the handle.

It is a first object of the invention to overcome the deficiencies of the prior art.

It is another object of the invention to provide a useful, low cost disposable utility knife that is made up of few parts.

It is another object of the invention to provide a low cost disposable utility knife that is made up of few parts and includes an integral automatically activated safety cover that covers the sharpened edge of the exposed blade when the blade is not in use.

It is yet another object of the invention to provide a utility knife that is easy to use and that uses both sides of the conventional utility blade without opening the handle assembly.

SUMMARY OF THE INVENTION

A utility knife includes an elongaged handle having an internal cavity, two opposing ends and a side having at least one locking opening. A shuttle is sized to slide within the cavity and has a side surface. The shuttle has a spring-loaded locking button projecting from the side surface and into the handle. The button is sized and shaped to selectively project into the at least one locking opening. The shuttle is bonded to a conventionally shaped utility knife blade of the type which includes two opposing cutting regions. The shuttle can slide within the handle between the two opposing ends so that both cutting regions of the blade can be easily used as necessary. This utility knife is meant to be lost cost and disposable, but offers the user TWO cutting edges, doubling its effective use.

BRIEF DESCRIPTION OF THE DRAWINGS

The invention can be more fully understood from the following detailed description taken in conjunction with the accompanying drawings, in which.

DETAILED DESCRIPTION OF THE PREFERRED EMBODIMENTS

Figure 1:
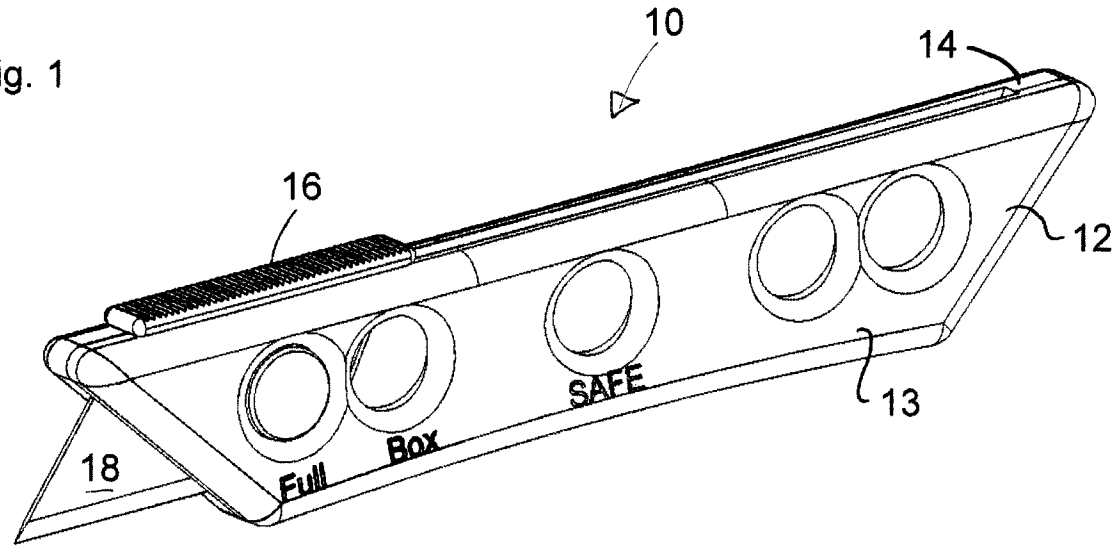
FIG. 1 is a perspective view of a utility knife, according to the present invention including a handle having locking openings, a shuttle and a blade.
Figure 2:
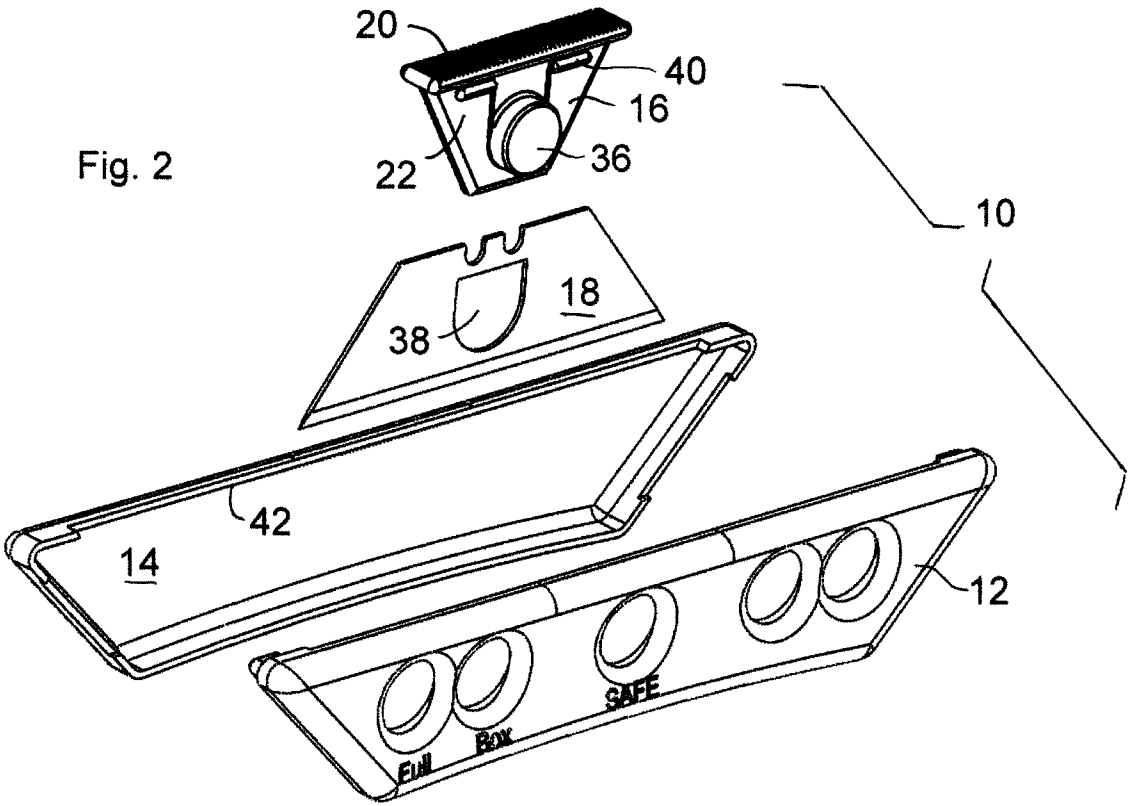
FIG. 2 is a perspective assembly view of the knife of FIG. 1, including the blade, the shuttle, and the handle having two halves, according to the invention.

Referring to FIGS. 1 and 2, a knife 10 according to the invention is shown having a handle assembly 12 including a locking handle half 13 and a cover handle half 14, a shuttle 16 and a blade 18. The construction of this present knife 10 is very simple with few parts and is meant to be disposable by the user, but of course may be made so that blade 18 can be accessed by the user and replaced with a new blade, as can be appreciated and understood by one of ordinary skill in the art. However, according to the preferred embodiment of this invention, blade 18 is permanently bonded to shuttle 16 and cannot be removed from between handle halves 12, 14 once secured therein, as described below.

Figure 3:
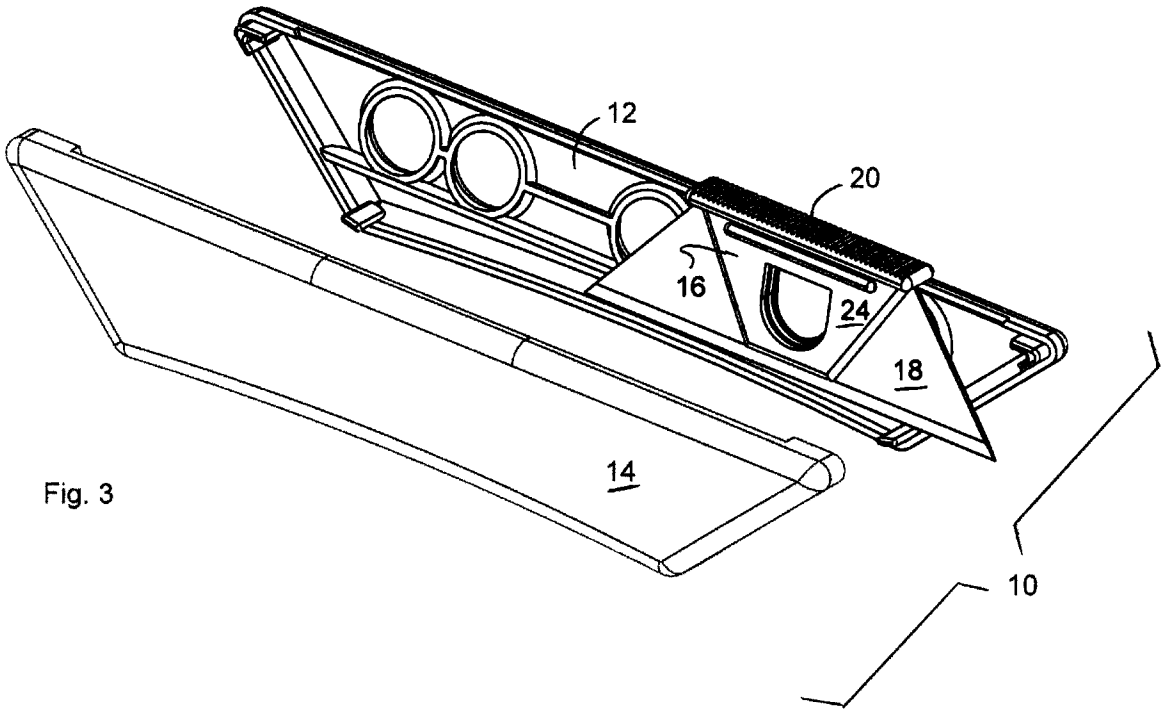
FIG. 3 is a perspective assembly view of the knife of FIG. 1, including the blade secured within the shuttle and the shuttle positioned within one half of the handle, according to the invention.
Figure 4:
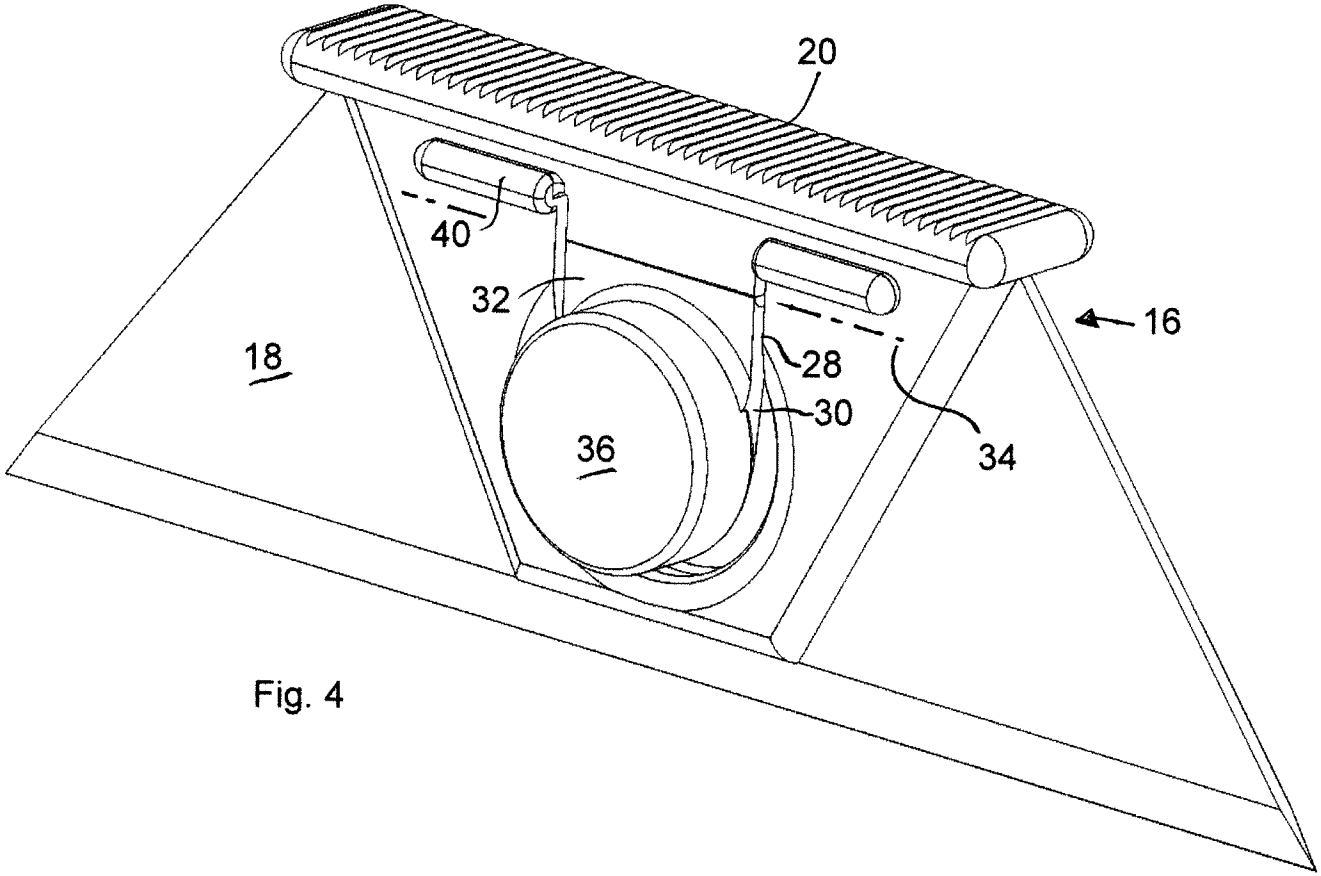
FIG. 4 is a front perspective view of the shuttle showing the blade secured therein and also showing a spring-biased locking button located in a rest position, and a finger-gripping pad, according to the invention.

As shown in FIGS. 3 and 4, shuttle 16 includes a grip plate 20 and two opposing bonding plates 22 and 24 which define a blade channel 26 therebetween. Blade channel 26 is sized to snugly accommodate blade 18 so that blade 18 may be positioned within blade channel 26 during assembly and bonded therein using an appropriate adhesive and/or heat (using an ultra-sonic welding process, for example) and/or a mechanical fastener, such as a rivet or screws. Blade 18 may include appropriate openings (not shown) for assisting in the bonding process to receive fasteners, adhesive, or plastic, as is well known to those of ordinary skill in the art. Regardless how it is secured, blade 18, according to the preferred embodiment of this invention, is firmly bonded to shuttle 16 during manufacture and cannot be removed during normal use of knife 10.

Bonding plate 22 includes a slot 28 that defines a flexible platform 30 which is pivotally connected to plate 22 by an attached portion 32, about a hinge axis 34, as shown in FIG. 4. As is understood by those skilled in the art, the flexible characteristics of flexible platform 30 is controlled by the material used to make shuttle 16, the shape and size of slot 28 and the thickness, shape and area of the attached portion 32 of platform 30.

Figure 5:
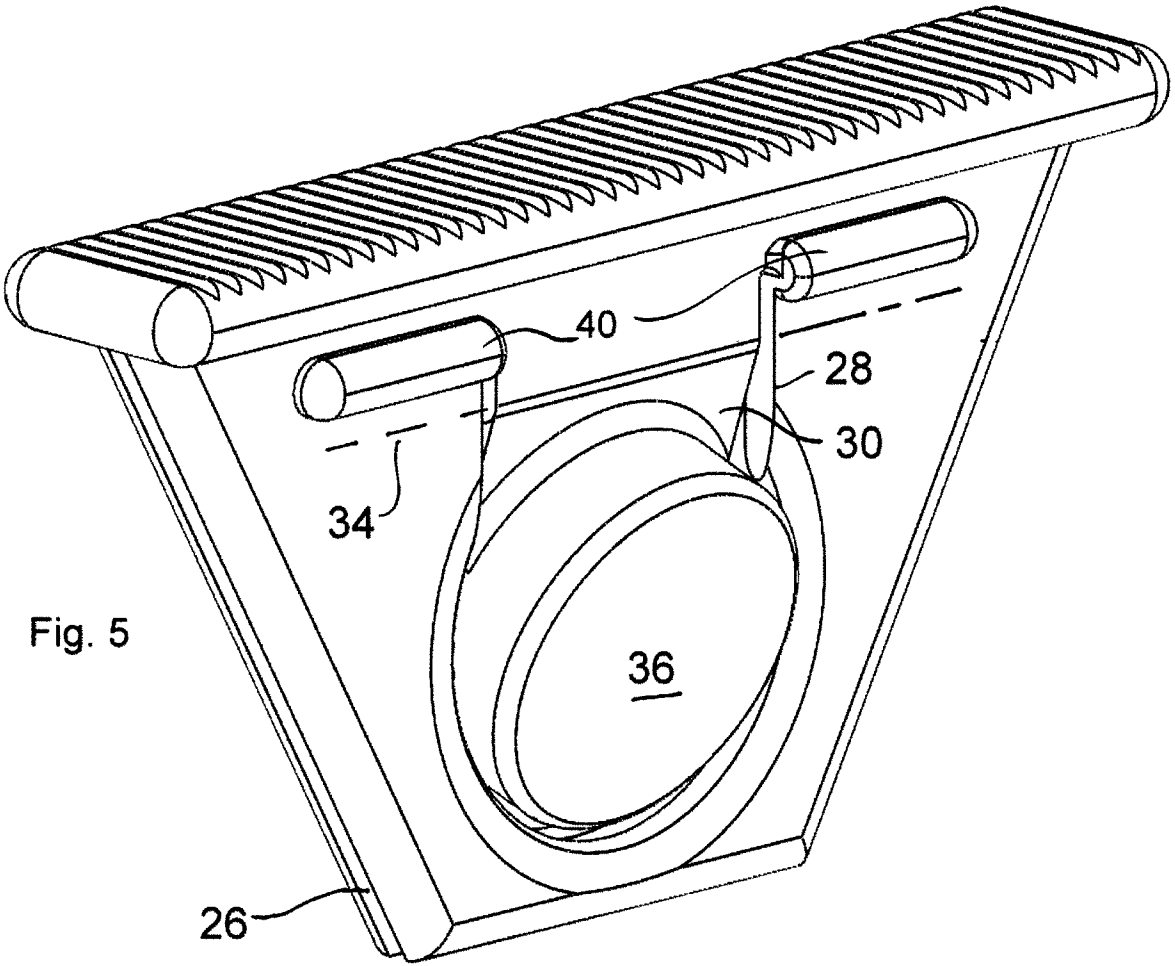
FIG. 5 is a front perspective view of the shuttle shown without a blade and having the spring-biased locking button located in a fully depressed position, according to the invention.

As shown in FIGS. 4 and 5, a locking button 36 is integrally formed to flexible platform 30 so that button 36 may pivotally displace about hinge axis 34 from a rest position shown in FIG. 4 and a fully depressed position shown in FIG. 5. As described below, as button 36 is depressed, it will pivot against the inherent spring bias of the attached portion 32 in such a manner that will cause button 36 to automatically return to rest position, shown in FIG. 4.

As shown in FIG. 2 and according to this preferred embodiment of the invention, blade 18 is made with a large opening 38 generally centrally located. This opening is sized and shaped to accommodate displacement of flexible platform 30 and button 36 when it moves from the rest position to the fully depressed position. Button 36 is preferably made pretty large so that the user may easily depress the button during use of the knife, as described below, however, button 36 may be any size and any shape depending on the design particulars of the knife to which the present invention is applied.

Figure 6:
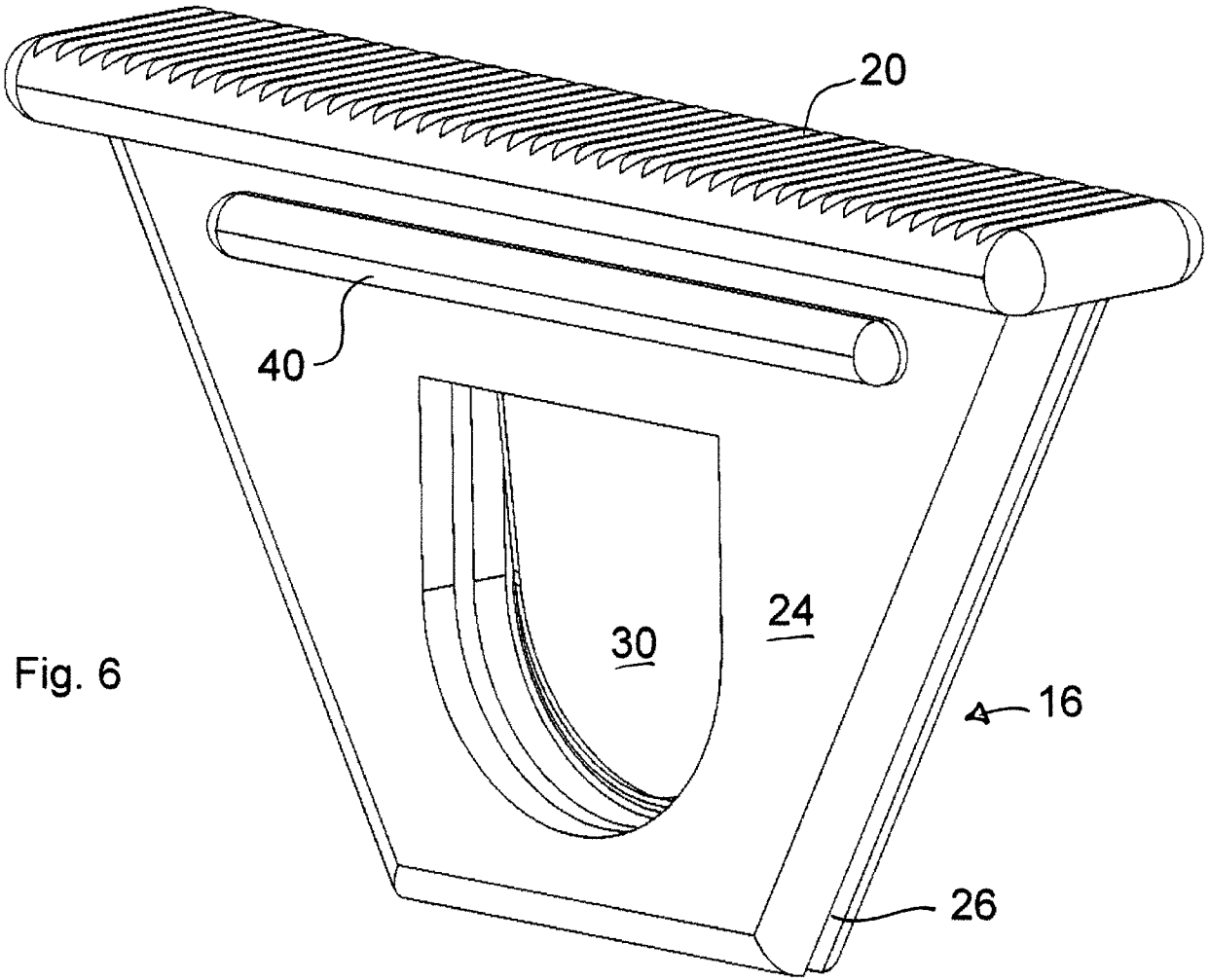
FIG. 6 is a rear perspective view of the shuttle shown without a blade, according to the invention.

Referring to FIGS. 5 and 6, shuttle 16 further includes guide rails 40 which are parallel and spaced from grip plate 20 a predetermined distance. As shown in FIG. 1, grip plate 20 is positioned above and outside handle assembly 12 and may slide along handle assembly 12 within a slot 42 so that shuttle 16 and blade 18 may be displaced along the full length of knife 10. The linear displacement of shuttle 16, grip plate 20 and blade 18 is restricted by the length of slot 42. Guide rails 40 are spaced so that they reside and slide smoothly within handle assembly 12 along the underside of slot 42. Guide rails 40 and grip plate 20 work together to ensure that shuttle 16 and the attached blade 18 move evenly and smoothly within handle assembly 12 along its length, as desired and controlled by the user.

Referring to FIGS. 1, 2, 8, 9 and 10, locking handle half 13 includes preferably five locking openings, a left "full" opening 48, a left "box" opening 50, a centrally located "safe" opening 52, a right "box" opening 54, and a right "full" opening 56. The purpose of these openings 48, 50, 52, 54, and 56 is to receive and hold button 36 when the button aligns with any one of the openings. Button 36 is shaped and sized to snugly fit within any one of the openings 48-56 when in its rest position so that once button enters within any one of openings 48-56, it will remain there by spring-bias of flexible platform 30 until button 36 is depressed to its fully depressed position.

During manufacture, blade 18 is registered and positioned within blade channel 26 of shuttle 16 and bonded thereto during any appropriate process, as described above. Applicant contemplates blade 18 being co-molded or over-molded with shuttle 16 during an injection process known by those in the art so that blade 18 becomes bonded to shuttle 16 as shuttle 16 is made through injection molding. In this over-molding process, blade 18 is precisely positioned within an injection mold of shuttle 16 so that as an appropriate plastic is injected into the mold, the plastic will flow around and bond to the inserted metal blade. When the part is cooled and ejected, the metal blade would effectively be bonded to the plastic shuttle.

Figure 7:
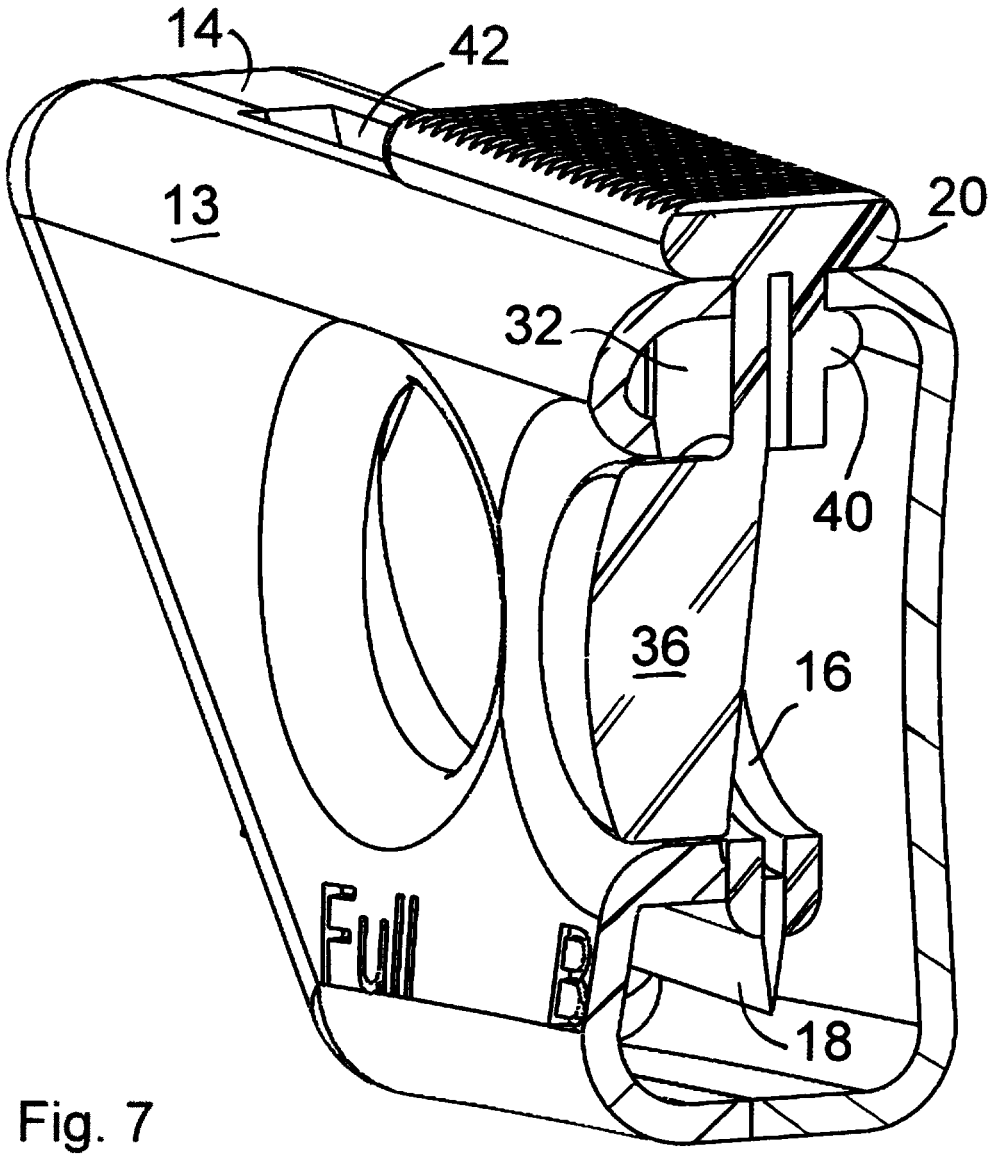
FIG. 7 is a partial sectional view of the knife of FIG. 8 showing details of the locking tab, according to the invention.
Figure 8:
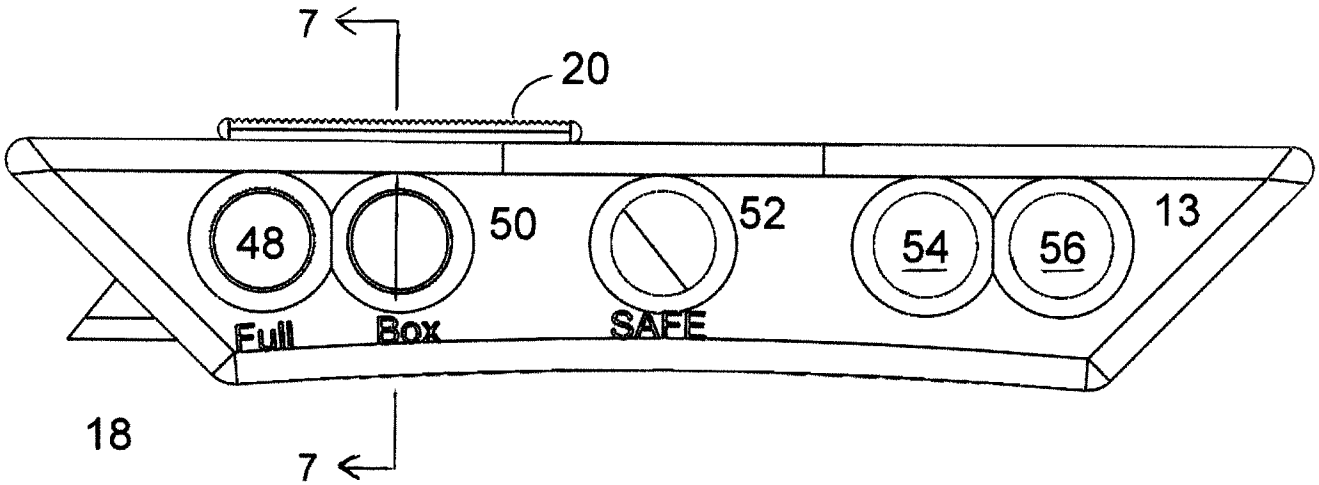
FIG. 8 is a side view of the knife according to the invention showing the shuttle and blade locked in a "Box" cutting position.
Figure 9:
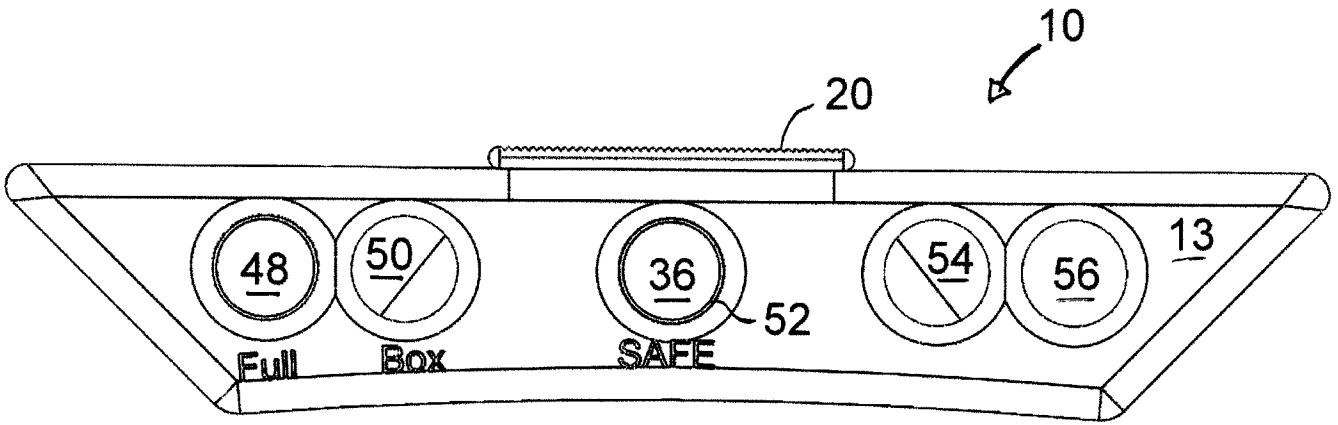
FIG. 9 is a side view of the knife according to the invention showing the shuttle and blade locked in a "SAFE" position.

Regardless, once blade 18 and shuttle 16 are formed, shuttle 16 is then positioned within slot 42 of handle assembly 12 so that grip plate 20 is positioned outside handle assembly 12 and guide rails 42 is positioned just within handle assembly 12, as shown in FIG. 7. Handle halves 13 and 14 are then bonded together using any appropriate method, such as ultrasonic welding or an adhesive. Shuttle 16 can then slide within handle assembly 12 along the length of slot 42 until button 36 aligns with any one of openings 48-56 and enters therein by spring bias of flexible platform 30. Once button 36 enters any one of openings 48-56, its engagement will lock shuttle 16 in position and will prevent any linear displacement of shuttle 16 and attached blade 18. Once the user depresses button 36 into handle assembly 12, grip portion 20 may be used to slide shuttle 16 (with blade 18) to a different position within slot 42 along handle 12 until button 36 again "finds" another opening 48-56. FIG. 7 shows (in section) button 36 in a rest position and locked within left "box" opening 48. Since openings 48-56 are positioned at different locations along handle assembly 12, either side of blade 18 may protrude a prescribed distance from either respective end of handle 12 for useful cutting work. For example, a fully exposed blade 18 at the left side of knife 10 is shown in FIG. 1. This arrangement is useful for general cutting of materials such as sheetrock, paneling, or carpet and other applications where a long cutting edge is required. FIG. 8 shows button 36 locked within left "box" opening 48 and left side of blade 36 shown exposed a shorter distance from handle 12 which is appropriate for cutting boxes. The user may slide shuttle 16 and blade 18 so that it resides in the middle of handle assembly 12 in a safe position so that no portion of the blade is exposed or accessible to the user (or anyone). This arrangement is shown in FIG. 9.

Figure 10:
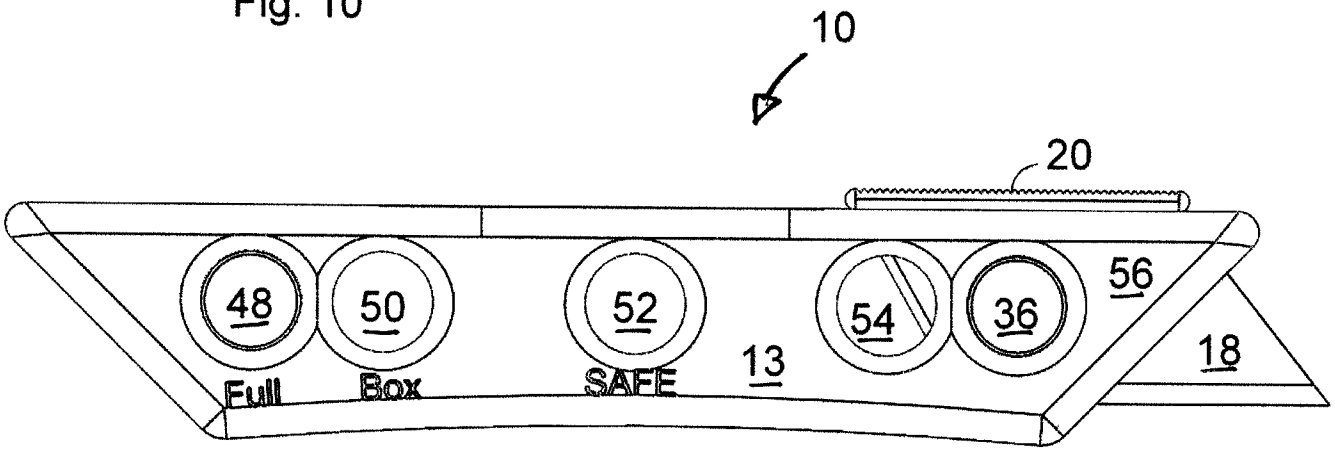
FIG. 10 is a side view of the knife according to the invention showing the shuttle and blade locked in a "Full" position exposing the blade on the opposing side of the handle.

Finally, FIG. 10 illustrates that the user may further displace shuttle 16 and blade 18 to the right so that the right side of blade 18 may be used on the opposing (right) side of handle assembly 12. This allows the user to quickly and easily use both sides of a single blade 18.

Figure 11:
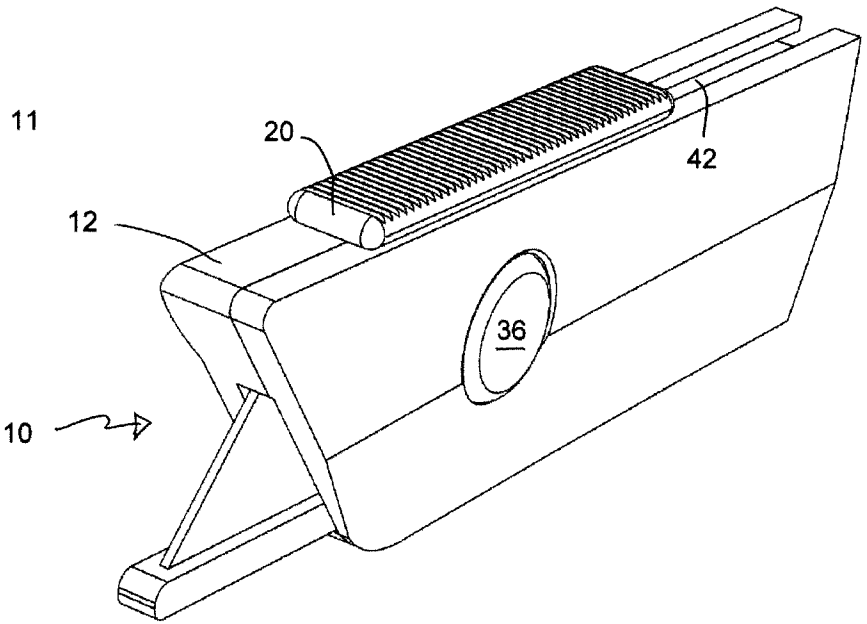
FIG. 11 is a perspective partial view of a knife according to a second embodiment of the invention including a handle, a blade, and a shuttle including a blade guard.
Figure 12:
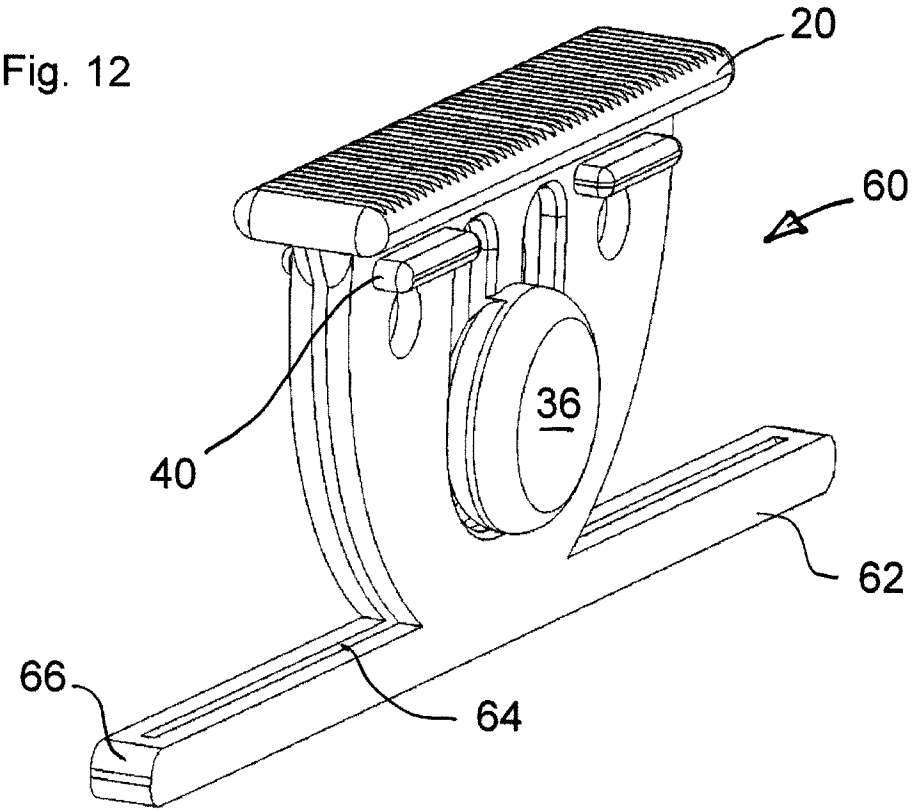
FIG. 12 is a perspective view of the shuttle of FIG. 11 showing details of the blade guard, according to the second embodiment of the invention.
Figure 14:
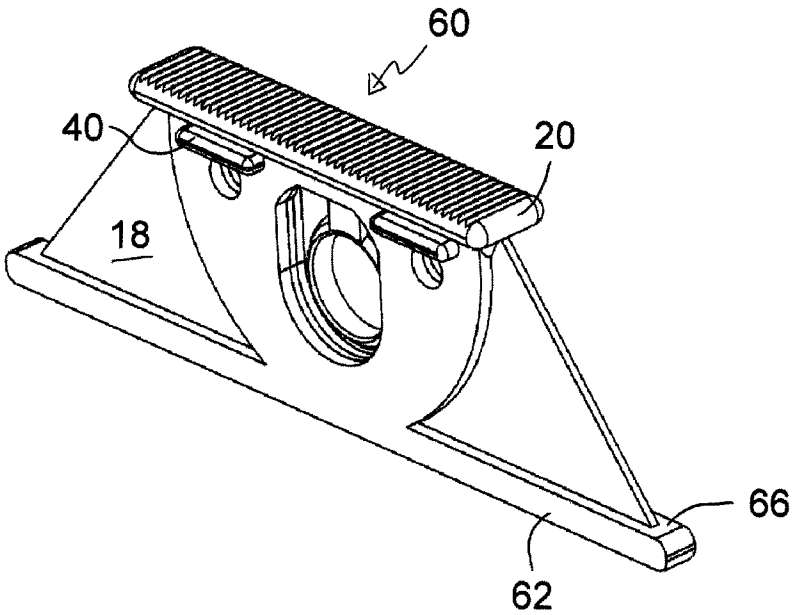
FIG. 14 is a perspective view of the shuttle with a blade secured thereto, according to the second embodiment of the invention.

Referring now to FIGS. 11 and 12, knife 10 is shown including a shuttle 60 that includes an integral blade guard 62, according to a second embodiment of the invention. The purpose of blade guard 62 is to provide temporary protection against a person contacting the sharpened edge of blade 18 and causing injury while blade 18 resides outside handle 12. As shown in FIG. 12, blade guard 62 is preferably formed integral with shuttle 60 and is made from a strong but resilient plastic that retains memory. Guard 62 includes a slot 64 that is sized to receive blade 18. As shown in FIGS. 11 and 12 and 14, guard 62 includes a closed end 66 that prevents guard 62 from moving across the sharpened edge. Closed end 66 can only move upwardly along blade 18 during use to expose the sharpened edge when knife 10 is being used. The tip of blade 18 will engage with closed end 66 of guard 62 and prevent any downward movement beyond the sharpened edge.

In use of this second embodiment, as the user slides shuttle 60 using the same method as in the above described first embodiment of the invention so that the blade extends to a fully exposed position, as shown in FIG. 11, the guard 62 moves with the blade so that the sharpened edge of the blade is always protected, always covered. That is until the user presses the blade into a cutting surface at which point the cutting surface will force the guard 62 away from the blade and allow the sharpened edge of the blade to penetrate the cutting surface. Once removed from cutting surface, the flexible guard will spring back to its covering position over the sharpened edge.

Figure 13:
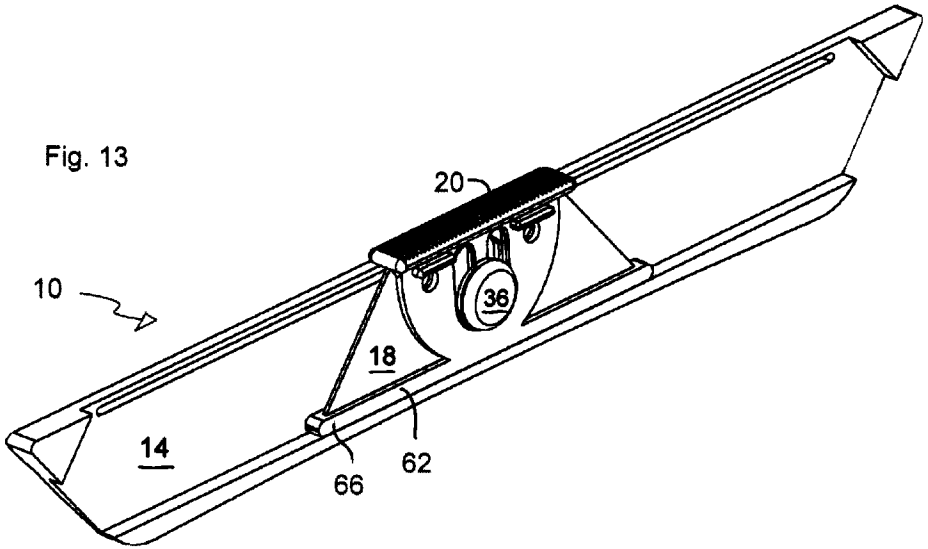
FIG. 13 is a perspective view of one handle half showing the shuttle and blade in position within the handle, according to the second embodiment of the invention.

According to this second embodiment, blade guard 62 is sized and shaped to slide freely within handle assembly 12 following the linear movement of blade 18, as shown in FIG. 13. Referring to FIGS. 15, 16, 17 and 18, a third embodiment of the invention is shown wherein a similar blade guard 70 to guard 62 is provided, again integrally formed with a shuttle 72, however in this embodiment, guard 70 always resides outside the handle 12, regardless of where the blade 18 is located.

Figure 15:
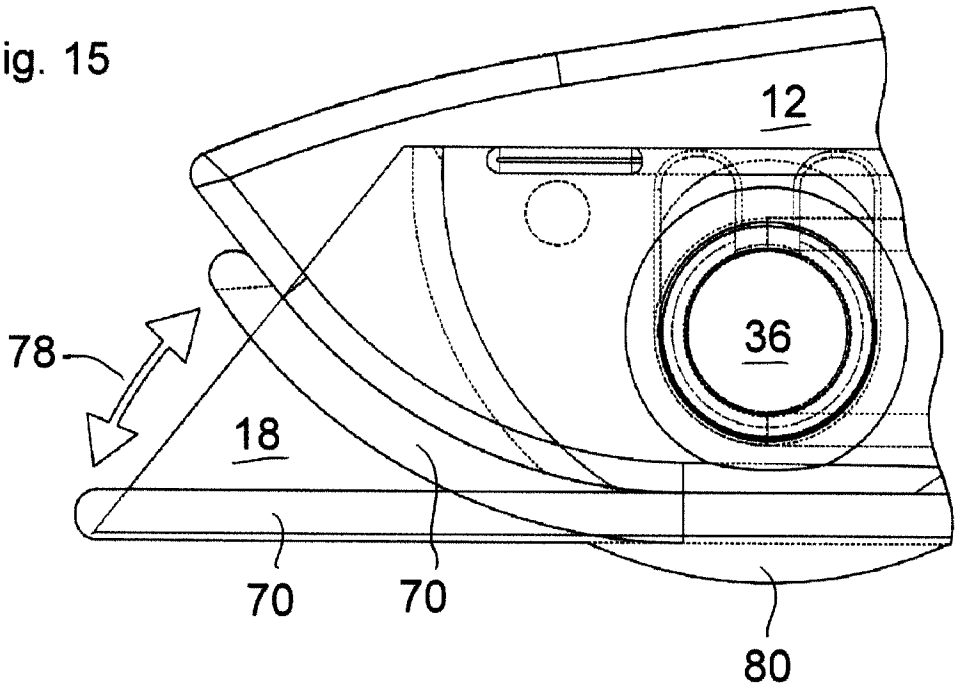
FIG. 15 is a perspective partial view of a knife according to a third embodiment including a handle, a shuttle having an integrally formed guard and a blade wherein the guard is shown in BOTH the guarded position AND the exposed position, according to the third embodiment of the invention.
Figure 16:
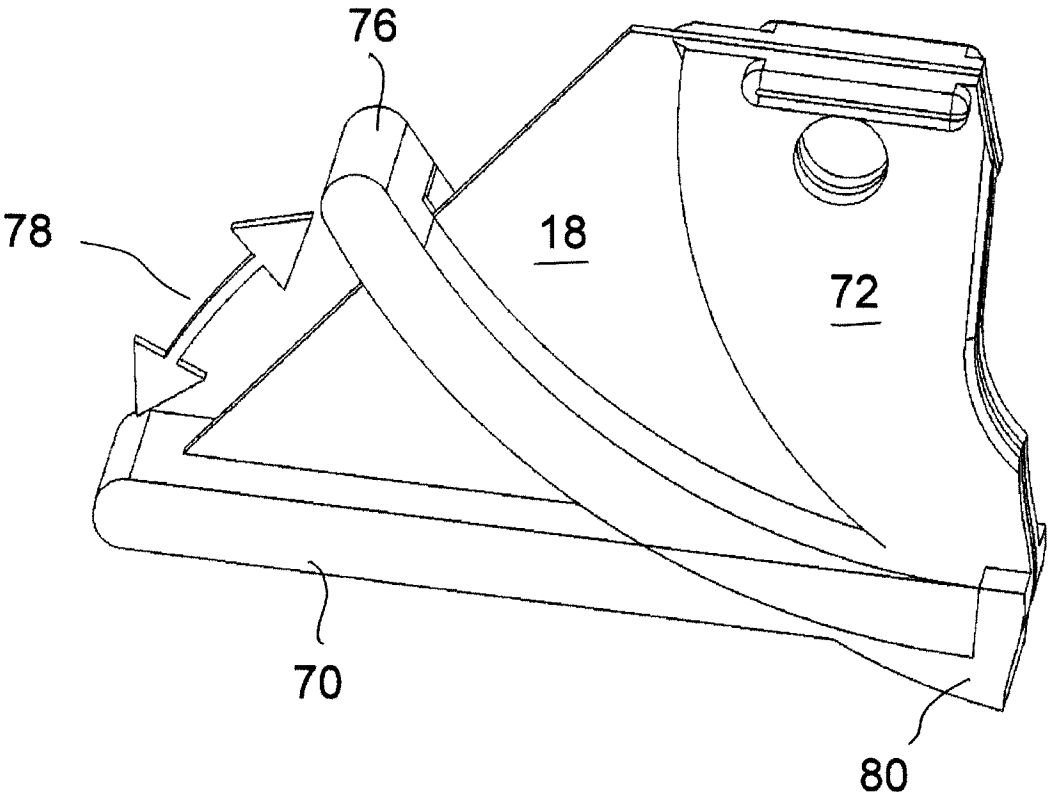
FIG. 16 is a shaded view of FIG. 15, according to the third embodiment of the invention.
Figure 17:
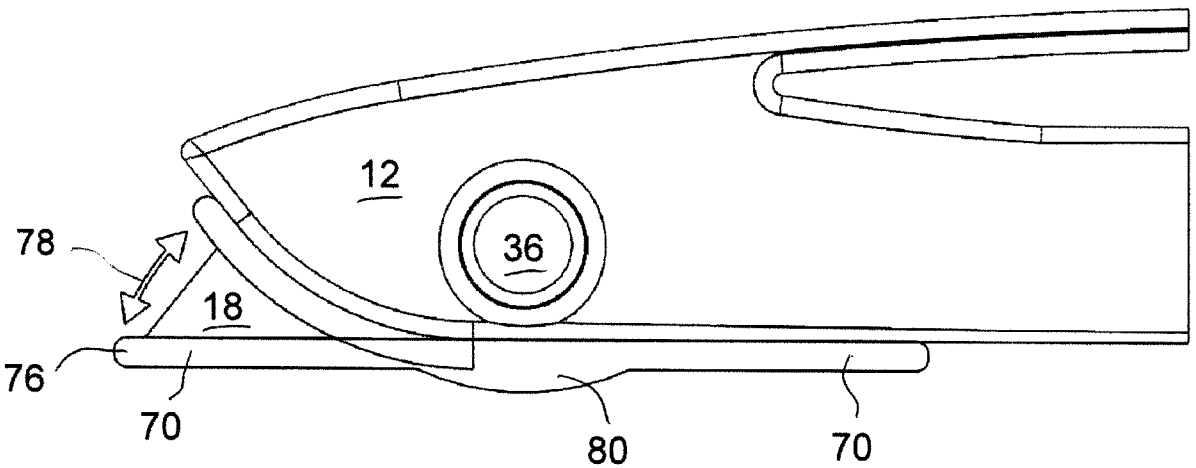
FIGS. 17 and 18 are both perspective views of the knife of FIGS. 15 and 16, showing how the guard remains outside the handle, according to the third embodiment of the invention.
Figure 18:
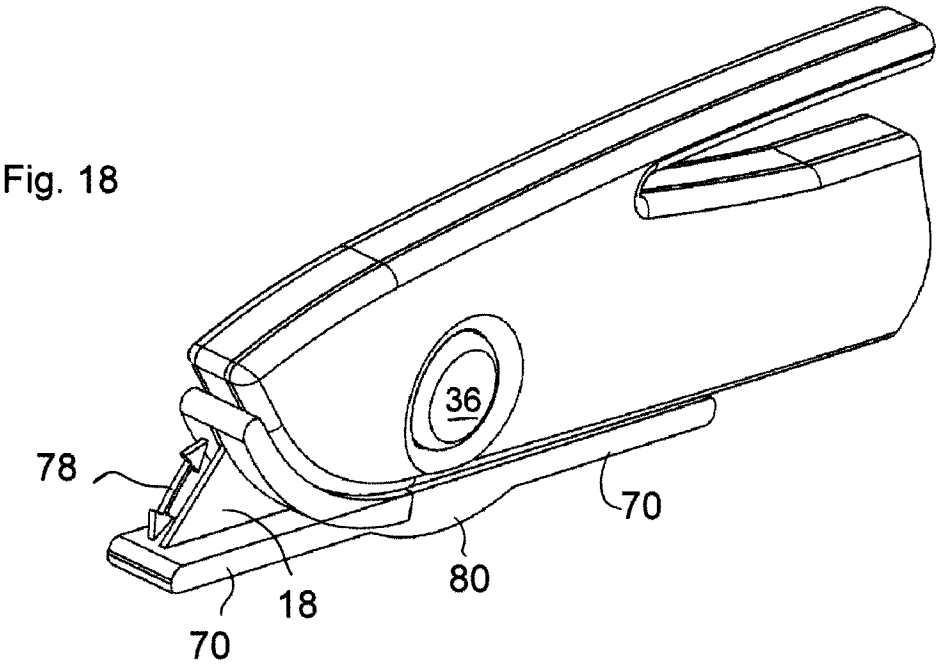

As in the second embodiment, described above, this guard 70 includes a slot 74 for receiving blade 18 and also includes a closed end 76. FIGS. 15 and 16 illustrates how the closed end 76 can move upwardly against the spring bias of the resilient plastic guard and cannot move downwardly beyond the sharpened edge of the blade 18 because the tip of the blade will engage with the closed end and prevent further movement. This movement is illustrated by arrows 78 in the figures. According to this embodiment, the sharpened edge of blade 18 actually resides outside handle assembly 12 even when blade 18 is moved back into a "safe" position within the handle. Guard 70 is designed to move with blade 18 and protect the sharpened edge regardless of where the shuttle is located with respect to handle 12. The guard is allowed to be displaced to expose the useful sharpened edge of the blade only when the blade is located in the extended position. When blade 18 is located within the handle 12 in the safe position, the guard abuts against the lower edge of handle 12 and is thereby forced into a fixed position tightly covering the sharpened edge of the blade.

Since the blade guard 70 of this embodiment is always exposed and always accessible to the user, the guard is used as a grip plate 80 which allows the user to use the guard to slide the shuttle 72 linearly with respect to the handle 12.

As mentioned above, in each of the embodiments described, all parts are preferably made from an appropriate plastic, such as: PVC, Polypropylene, Nylon®, Delrin®, Zytel®, any of the class of phenolics, including Micarta®, reinforced composites, such as "epoxy G-10", and other thermoplastics. The blade is preferably made from heat-treated steel, as understood by those skilled in the art. The plastic parts are preferably made using a high-pressure plastic injection molding process. Various sections of the plastic parts (e.g., the handle) may include a rubber overmold to provide a select cushioning and improved grip.

As shown in some of the figures, the openings 48-56 may include appropriate indicia, such as "FULL", "BOX" and "SAFE".

Also, although not shown, a spring or rubber band may be included within handle 12 to bias shuttle 16 to the safe position regardless of the direction the shuttle moves (left or right).

Also not shown is a tether for helping secure the blade to the user's wrist, if desired.

Also, cover handle half 14 is preferably without openings, but may include at least one opening that aligns with at least one of the openings 48-56 of locking handle half 13. These aligned openings may be used to hang the knife up when not in use.

Referring to FIGS. 19 through 32, a fourth embodiment of knife 100 is shown including a handle assembly 101 having a "cover" handle half 102, a "button" handle half 104, a shuttle 106, a blade cover 108, and a razor blade 110. This embodiment is similar to the previous three embodiments described above, but the overall shape of handle assembly 101 (combined handle halves) is generally arcuate with a gripping bulge 190, as described below. Also, shuttle 106 which slides within handle assembly 101 includes integrally molded snap fasteners that allow a blade cover 108 to securely snap to the shuttle 106 and thereby hold a metal razor blade 110 therebetween. Another difference is that a locking release button 112 is integrally formed to button handle half 104 along a "living hinge" so that the button 112 can pivot slightly when depressed. The button 112 in this fourth embodiment remains in place within the handle assembly 101 whereas in the above described previous embodiments, button 36 is integrally molded to shuttle 16 so that it moves with the shuttle when shuttle 16 is slid within the handle.

In explaining this fourth embodiment of the invention in greater detail, first refer to FIGS. 22-26 to show how razor blade 110 is secured to shuttle 106. In earlier embodiments, the razor blade was preferably secured to the plastic shuttle assembly using an appropriate adhesive or bonded to the plastic directly using co-molded techniques during molding or ultrasonic welding after molding. As can be seen in FIGS. 22-26, razor blade 110 of this fourth embodiment can be a standard utility blade in size and shape and thickness, but instead of having two notches along the upper edge, it preferably includes three holes 114 cutout in a triangular pattern in its body with two holes located along the top edge and one centrally located near the sharpened bottom edge 116. Holes 114 are sized, shaped and positioned to fit onto three split posts 118 that have been integrally molded on one side of shuttle 106.

Figure 22:
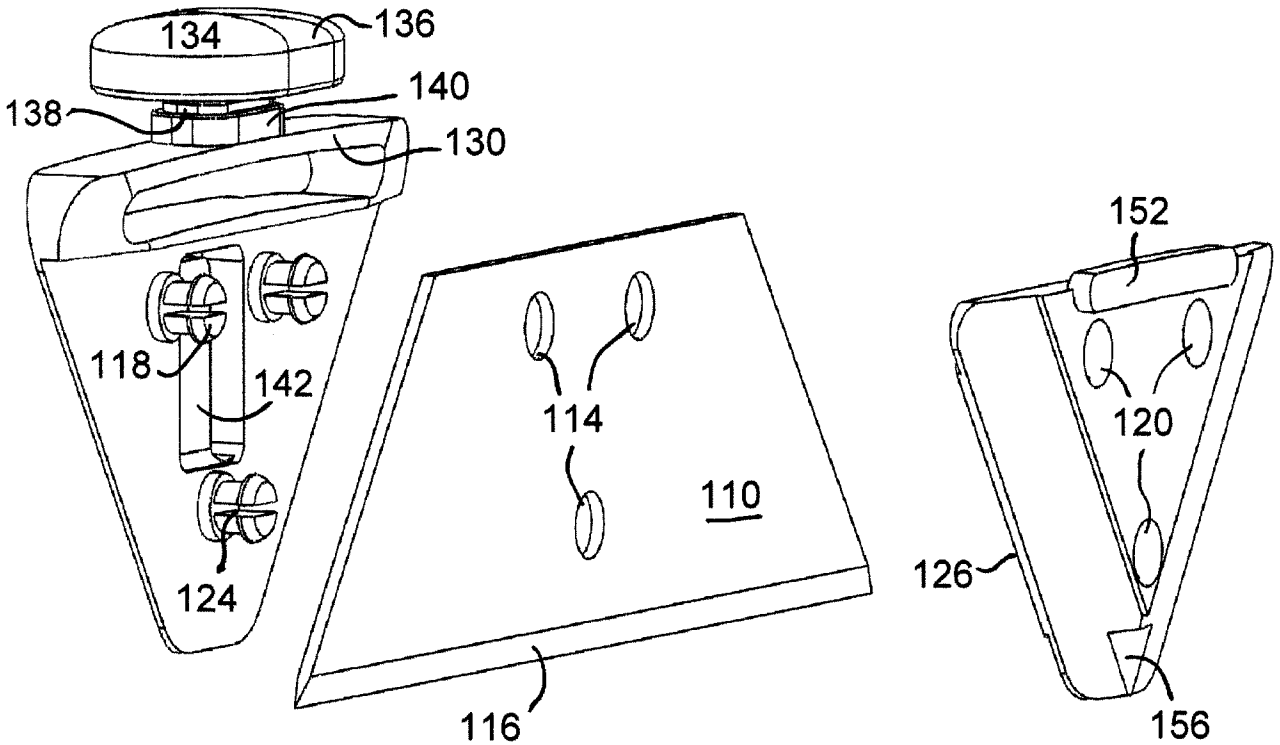
FIG. 22 is a perspective view of a shuttle blade assembly, according to the fourth embodiment of the invention, showing details of how the blade and blade cover are secured to the shuttle.
Figure 23:
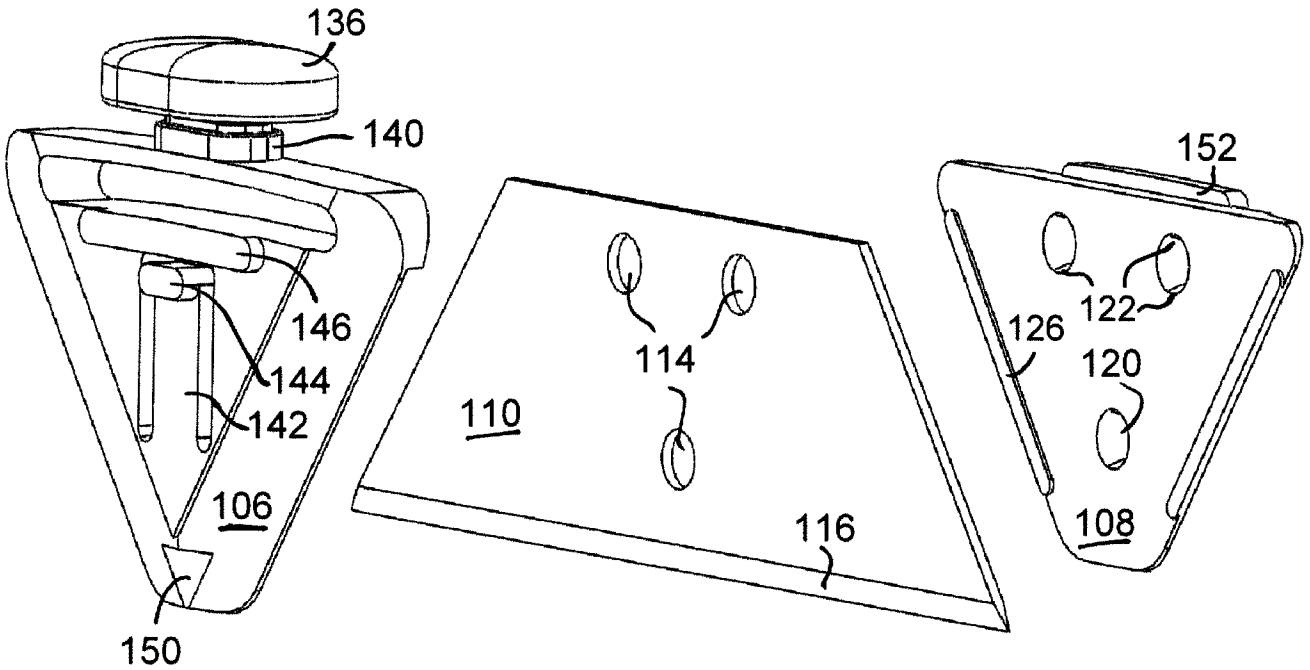
FIG. 23 is an opposing perspective view of FIG. 22.
Figure 26:
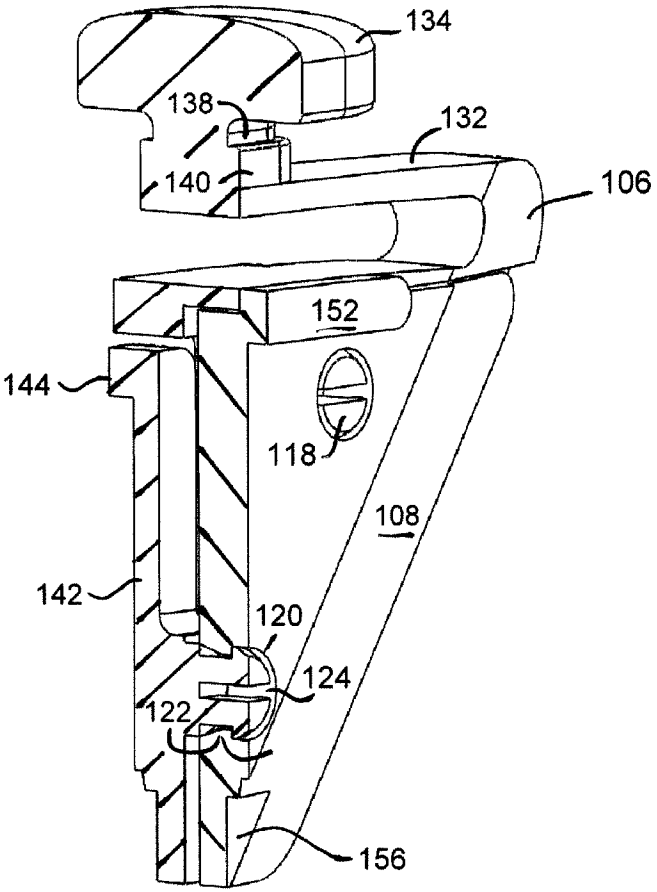
FIG. 26 is a cross-sectional view of the shuttle assembly of this fourth embodiment, showing details of how the blade cover locks to the split posts of the shuttle (blade is not shown) and showing details of a locking arm and engagement tab.

Once the blade is fitted to shuttle 106 so that each of the three split posts is located within one of the three holes 114 of blade 110, blade cover 108 can then be positioned adjacent the blade, opposite the shuttle. As can be seen in FIGS. 22 and 26, blade cover 108 also includes three bores 120 that are sized and positioned to receive split posts 118 of shuttle 106. Each bore 120 includes at least one integrally molded locking ramp 122 that is designed to automatically lock onto the projected structure of each split post 118 in a one-way snap locking arrangement that is well known to those skilled in the art. The gap 124 located along the central axis of each split post 118 allows the each post structure to deflect and lock onto each respective locking ramp 122 as the two are forced together. The spring resiliency of the plastic allows each post structure to return to the original shape and thereby "lock" onto the ramp structure. This locked position is illustrated in FIG. 26 as a cross section view.

So, to lock blade 110 onto shuttle 106, blade cover 108 is pressed firmly against blade and shuttle until each locking ramp 122 engages with each respective split post 118 of shuttle 106. To help increase the lateral compression force (the squeeze force) by the shuttle and the blade cover against the interposed blade, applicant has included small ridges 126 located on the inside surface 128 of blade cover 108, shown in FIG. 23. Ridges 126 are located along edges of blade cover 108 relatively remote from bores 120. During assembly of the blade to the shuttle, ridges 126 will contact the surface of the blade before locking ramps can lock onto the respective split post structure. The center of blade cover must be forced into blade and shuttle so that blade cover deforms between ridges 126. The deformation resembles a kind of inwardly cupping. This cupping allows each split post to lock into each respective bore. Once the compression force is released, the engagement to each of the three split posts 118 will keep blade cover 108 cup-shaped and the spring resiliency of blade cover 108 will continue to apply a strong compression force towards shuttle 106—resulting in firmly holding the blade therebetween.

Figure 24:
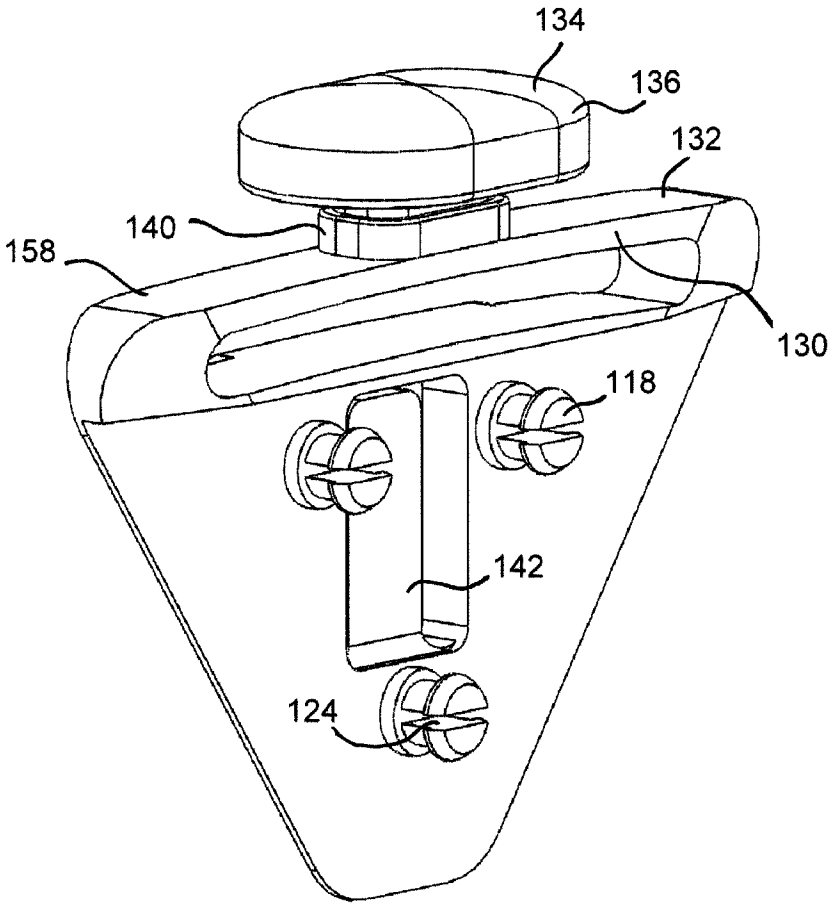
FIG. 24 is a perspective view of the shuttle, according to the fourth embodiment of the invention.
Figure 25:
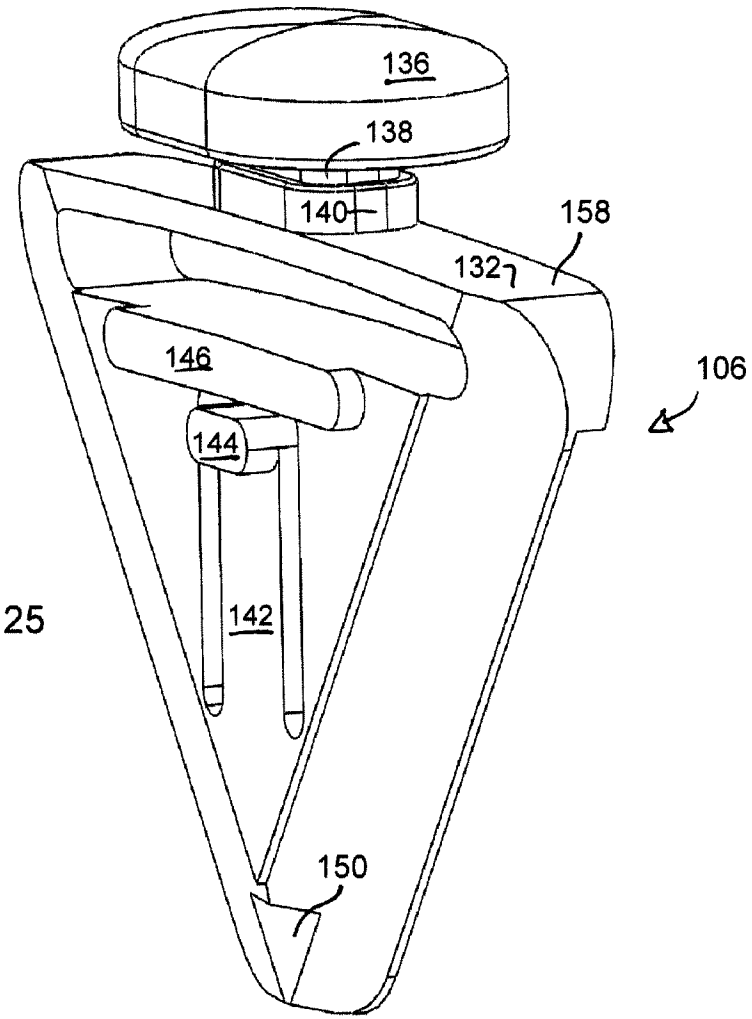
FIG. 25 is an opposing perspective view of FIG. 24.

Referring to FIGS. 24 and 25, shuttle 106 is generally triangular in shape and further includes an integrally formed bridge structure 130 along its upper edge 132. Bridge structure 130 defines an opening positioned along upper edge 132. Owing to the plastic material, bridge structure is meant to have a resilient spring bias so it can be pressed downward against the spring bias. When released, the bridge preferably returns upwardly to its original rest shape and position. A sliding control button 134 is formed to bridge structure 130, preferably at a central location. Button 134 includes a contact pad portion 136, a neck 138 and a locking shoulder 140. Locking shoulder 140 is larger than neck 138 but smaller than contact pad portion 136.

Also located on shuttle 106 is a transverse locking arm 142 and an engagement tab 144. As shown in FIG. 25, engagement tab 144 extends outward from shuttle 106. Shuttle 106 also includes a slide 146 that is sized and shaped to slide along an upper surface 147 of a guide rail 148 formed in button handle half 104. Shuttle 106 also includes a flat contact surface 150 located along the lower portion of the triangular shuttle.

As shown in FIG. 22, blade cover 108 includes an integrally formed slide 152 that is sized and shaped to slide along an upper surface 153 of a guide rail 154 formed within cover handle half 102. Slides 146 and 152 are preferably formed so that they align with each other, although this is not necessary for the shuttle to operate effectively within handle assembly 101 in according with this embodiment of the invention. Blade cover 108 also includes a flat contact surface 156 located at a lower point of blade cover 108.

Figure 21:
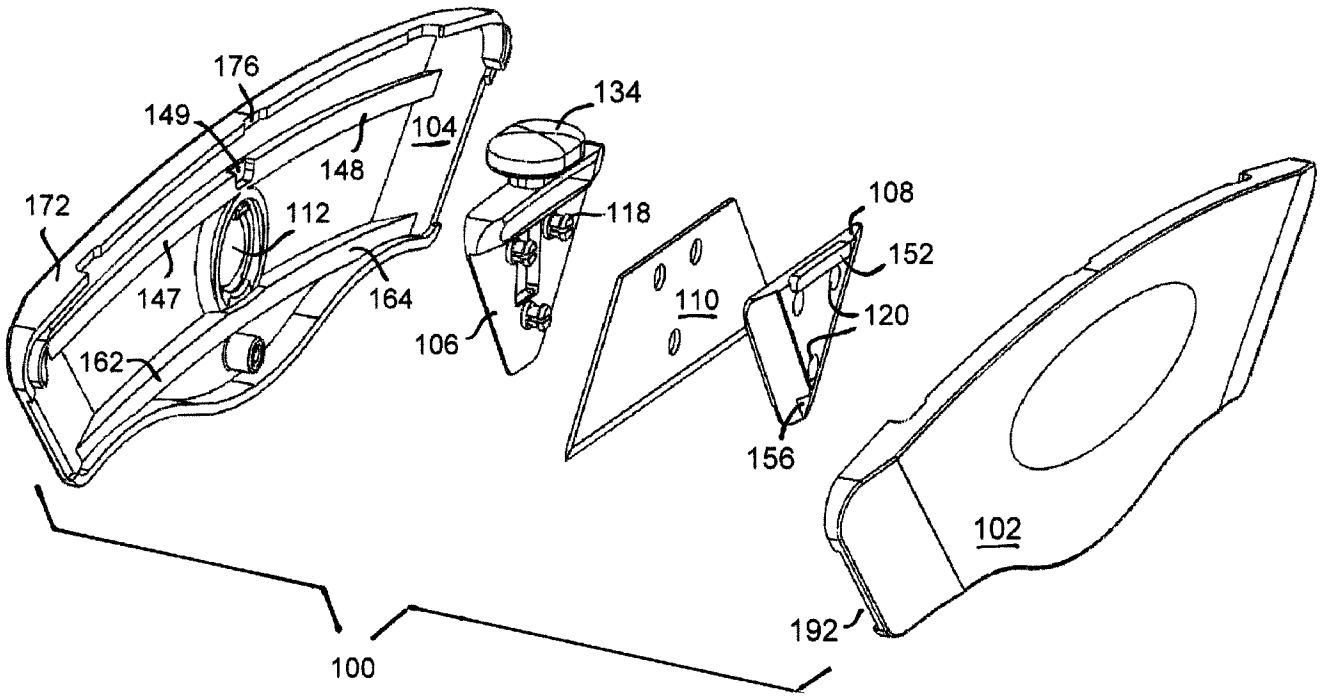
FIG. 21 is an opposing perspective view of FIG. 20.
Figure 27:
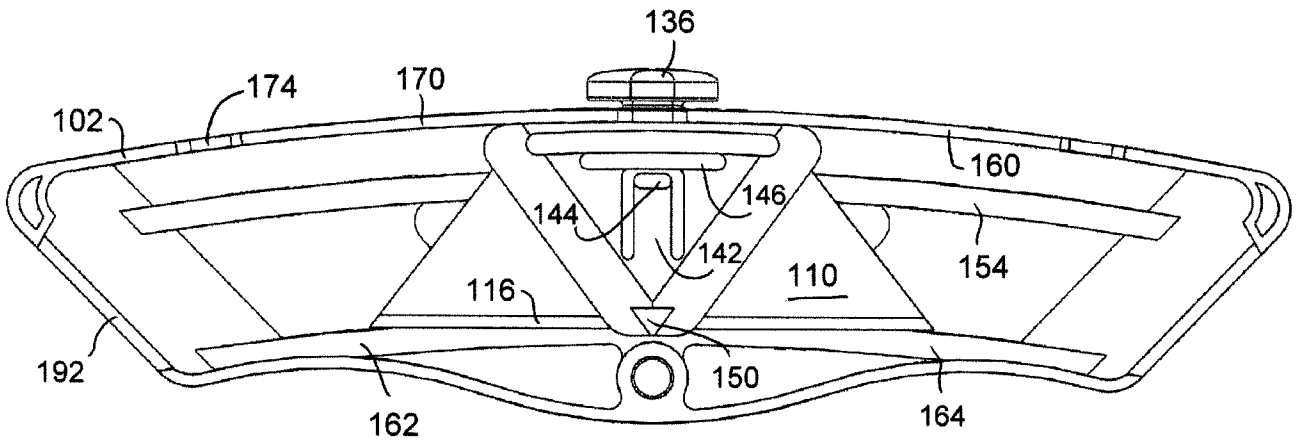
FIG. 27 is a plan view of the knife, according to the fourth embodiment of the invention without one handle half so that the shuttle can be viewed in the center "safe mode" position.
Figure 28:
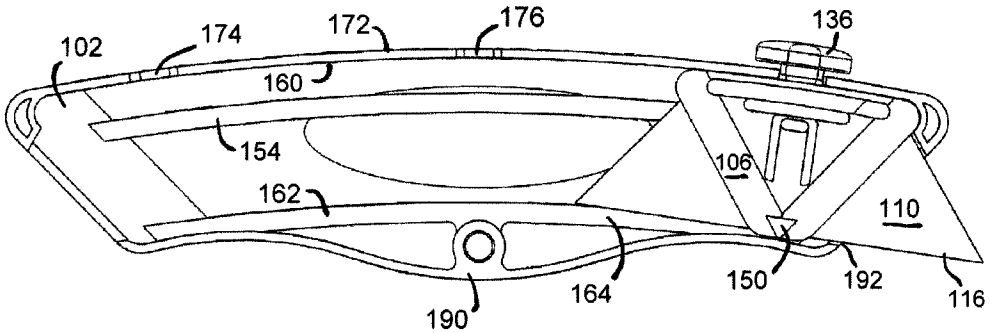
FIG. 28 is the same view of FIG. 27, showing the shuttle (and blade) in a full RIGHT position so that a portion of the blade projects from the handle.
Figure 29:
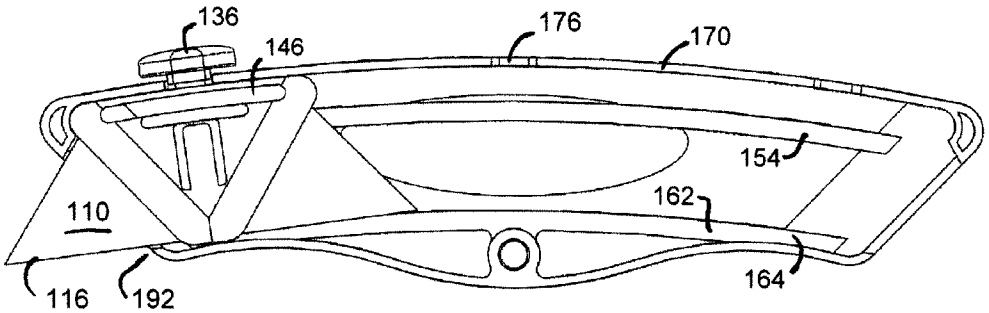
FIG. 29 is the same view of FIG. 27, showing the shuttle (and blade) in a full LEFT position so that a portion of the blade projects from the handle.

As shown in FIG. 27, shuttle 106 (with blade 110 secured thereto by a blade cover, not shown in the figure) is shown positioned in a central locking position within cover handle half 102. As mentioned above, cover handle half 102 includes a slightly curved guide rail 148. Shuttle is sized and shaped so that an upper surface 158 of bridge structure 130 becomes in sliding contact with an upper wall surface 160 of handle 102 while slide 146 comes into sliding contact with upper surface 147 of guide rail 148. Contact flat surface 156 is position so slide along an outside surface 162 of a lower guide ridge 164 of cover handle half 102. As shown in FIG. 21, a locking cutout 149 is provided within guide rail 148, preferably at a central location, aligned with button 112. The purpose of this locking cutout 149 is described below in explaining the "lateral locking" feature.

Figure 19:
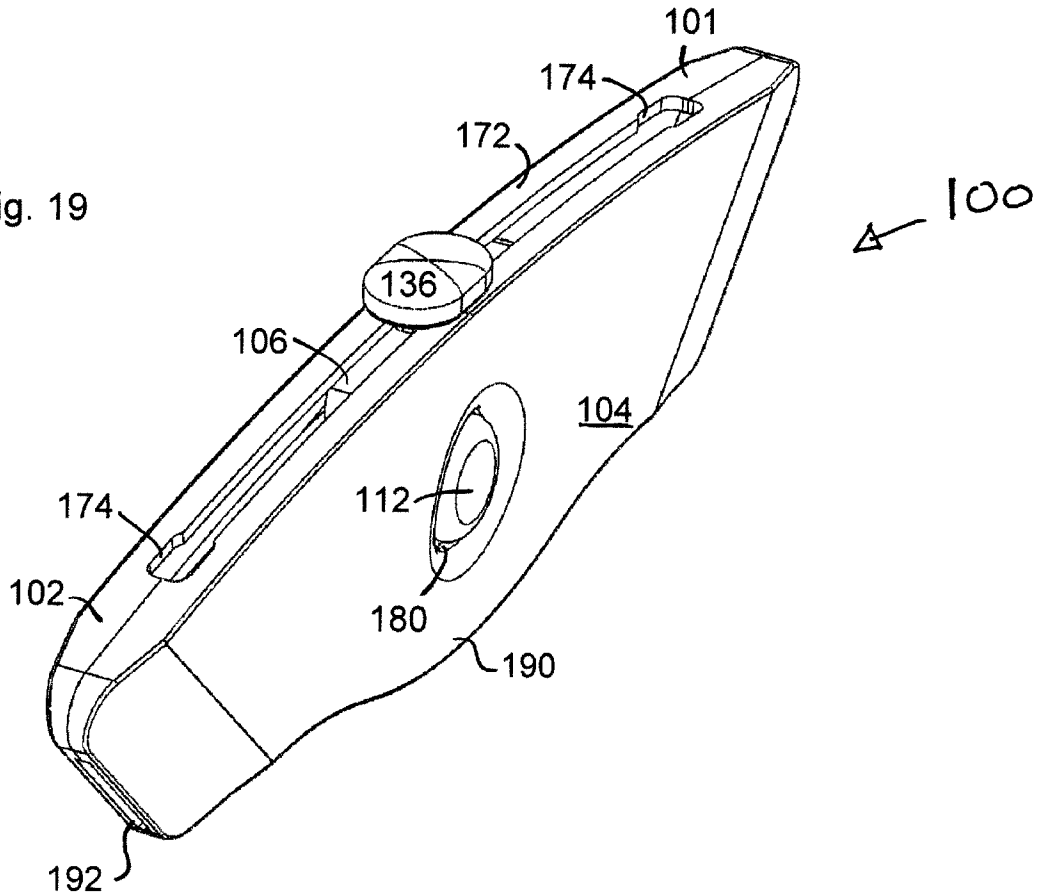
FIG. 19 is a perspective view of a knife according to a fourth embodiment of the invention, showing a handle assembly having a gripping bulge, two handle halves and a lock-release button.
Figure 20:
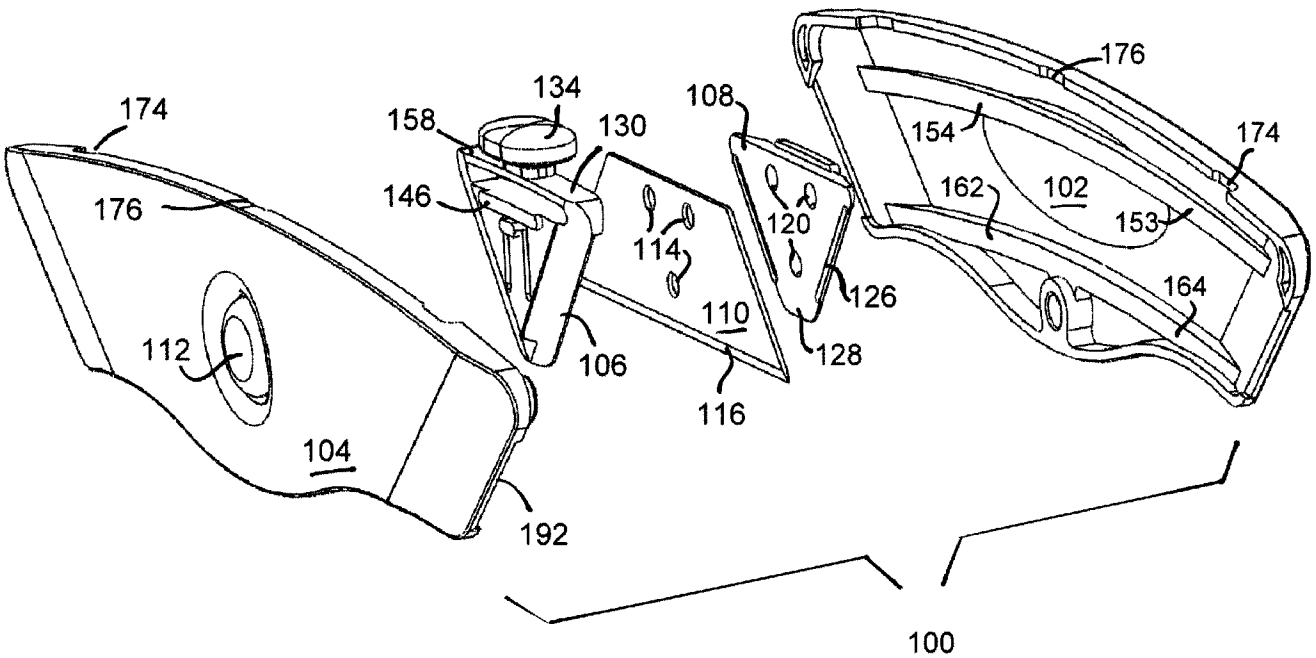
FIG. 20 is a perspective assembly view of the knife of FIG. 19, showing a shuttle, a blade, and a blade cover, according to the fourth embodiment of the invention.
Figure 31:
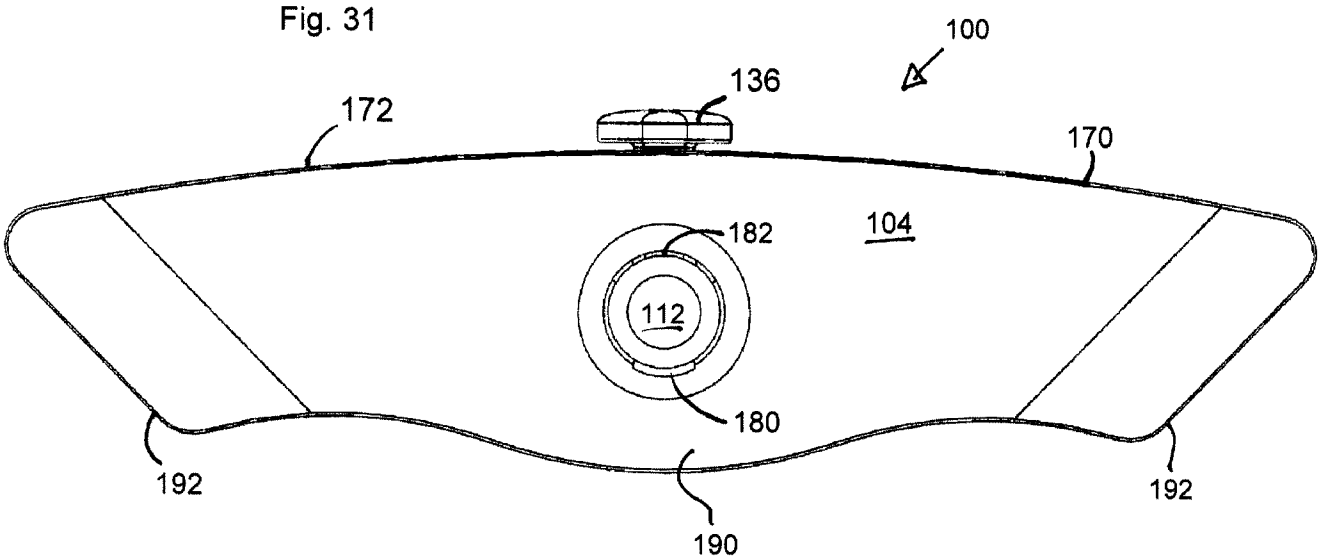
FIG. 31 is a plan side view of the knife according to the fourth embodiment showing details of the gripping bulge.

When button handle half 104 is secured to cover handle half 102 as shown in FIGS. 31 and 19, slides 146, 152 engage respective upper surfaces 147, 153 of respective guide rails 148, 154 of respective handle halves 102, 104. Meanwhile, upper surface 158 of bridge structure 130 comes into sliding contract with upper wall surface 160 of handle half 102 and upper wall surface 166 of handle half 104. All these structural features and relationships allows shuttle 106, blade cover 108 and blade 110 to slide (once unlocked) within the handle halves 102, 104, as desired from a central position, shown in FIG. 27 to a usable position to the RIGHT, shown in FIG. 28, wherein one section of the cutting edge of the razor blade 110 projects from the handle halves 102, 104, AND to a usable position to the LEFT, shown in FIG. 29, wherein an opposing section of the cutting edge of the razor blade 110 projects from the handle halves 102, 104. The preferred use of this knife is disposable wherein blade 110 cannot be replaced, nor can handle halves 102, 104 be separated to provide any meaningful access to within the knife structure. Therefore, an important feature of the present invention (all embodiments) is to provide the user with access to two cutting edges. This should extend the useful life of this knife by a factor of two. This can only benefit the user.

As described above, the shuttle and blade moves right to center to left to center to right again, as desired and follow a curved path. The curved handle shape provides a more comfortable orientation for the user during cutting because it allows the user to penetrate a cutting surface with an exposed blade without having to rotate the wrist downwardly as much as one would with a conventional straight knife.

Referring to FIGS. 19 and 31, when handle halves 102, 104 are secured to each other, using an appropriate adhesive, fasteners, or ultrasonic welding, a common slot 170 is defined along the upper outside surface 172. Slot 170 is sized to receive neck 138. Slot 170 preferably includes a widened cutout 174 located at least at each end of the slot. Widened cutout 174 is sized to accommodate locking shoulder 140. The relative height of locking shoulder on top of bridge structure 130 is such that when bridge structure is at its rest position (not depressed downward), locking shoulder 140 is of sufficient height to engage with either widened cutout 174 if shuttle is positioned within the knife so that locking shoulder aligns with either widened cutout. When the locking shoulder 140 engages widened cutout 174, shuttle 106 and blade 110 and blade cover 108 will not be able to move with respect to either handle half, i.e., it will be locked. This is very useful during cutting so the widened cutouts 174 are preferably positioned to lock shuttle 106, blade cover 108 and blade 110 when they are in the usable position at either end (LEFT AND RIGHT). Additionally, a central widened cutout 176 is preferably provided along slot 170 so that shuttle, blade and blade cover can be safely locked deep within the handle, i.e., the middle of the knife.

The above described widened cutouts 174, 176 make up vertical locking for holding the shuttle at prescribed locations with respect to the handle. The above described button 112 located in the middle of button handle half 104 works with the locking arm 142 and engagement tab 144 to form a "lateral locking" feature for further locking shuttle and blade with respect to the handle halves. This lateral locking feature is described in greater detail below.

Figure 30:
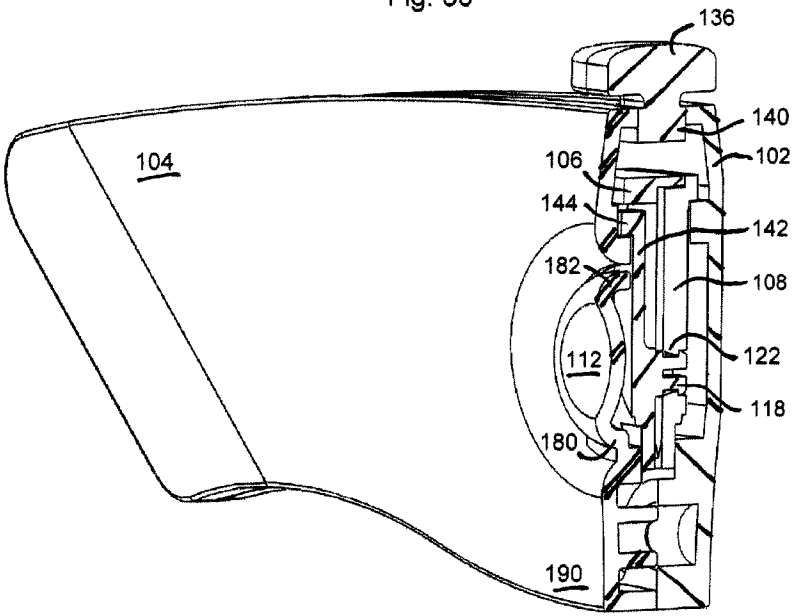
FIG. 30 is a sectional view of the knife of FIG. 19, according to this fourth embodiment with the shuttle and blade in the central safe mode location, showing details of the two locking features of the invention.

As shown in FIG. 30, button 112 of button handle half 104 includes a hinge member 180 that allows the button to pivot when pressed a predetermined amount. Positioned opposite the hinge member 180 on button 112 is a release member 182. Release member is sized and shaped to contact and depress a portion of locking arm 142 sufficiently to displace engagement tab 144 from a locked position wherein it is located within locking cutout 149 of guide rail 148 to an unlocked position thereby laterally unlocking shuttle 106 from button handle half 104.

Each handle half 102, 104 can include registration pins and sockets to help align and hold the two handles halves together.

As shuttle 106 moves within handle assembly 101, it is strongly guided by guide rails 148, 154 and slides 146, 152 AND is also stabilized by flat contact surfaces 150, 156 of shuttle 106 and blade cover 108 to engage lower guide ridges 164 of both handle halves 102, 104.

Also, it is to be understood that an appropriately sized and shaped opening is provided at each end of handle assembly 101 (matching cutouts 192 of each handle half, 102, 104) that will accommodate selective passage of blade 110 as shuttle 106 moves blade 110 to a fully extended cutting position.

In use, when the user first receives the present knife, according to this fourth embodiment, the user must depress button 112 located along the side of button handle half 104 AND simultaneously press down button 134 and slide shuttle to either the LEFT or the RIGHT. Upon pressing button 112, release member 182 will come into contact with a portion of locking arm 142 of the adjacently located shuttle 106 and will eventually push arm 142 sufficiently so that engagement tab 144 displaces out of engagement with locking cutout 149 of guide rail 148. The user holds the button in and as the user presses down on the button 134 against the spring bias of the bridge structure 130 sufficiently so that locking shoulder 140 displaces from engagement with the centrally located widened cutout 176. When both these locks are released, the user may then slide the shuttle to the left or the right by pushing or pulling on the button 134 so that neck 138 slides along slot 170 of the handle halves 102, 104.

Once unlocked, the shuttle will move into a "safe usable" position which is located between the fully LEFT or full RIGHT position AND the center position. In this position, the blade is not exposed, but the user may quickly and easily push button 112 to the full LEFT or RIGHT position until locking shoulder pops up into engagement with either widened cutout 174 by the spring bias of bridge structure 130. Once locked, the shuttle will be stable and one side of the cutting edge of the blade will be exposed and the knife can be used to cut something. When finished with a cut, the user can simply push the button 112 down against the spring bias of the bridge structure 130 of the shuttle 106 until the locking shoulder 140 exits the widened cutout 174 and the shuttle 106 and blade 110 can then be slid back into the "safe usable" position within the knife so that the blade will no longer be exposed. A simple metal or plastic spring (not shown) can be included to force the shuttle to the "safe usable" position either automatically after the blade leaves the cutting surface, or when the user releases the button 112. Regardless, friction of the engagement tab 144 sliding against the guide rail 148 AND the friction of the locking shoulder sliding along the inside surface of the combined knife handles 102, 104 will help prevent accidental movement of the shuttle when it is located between widened cutouts (in the safe usable position).

When the user slides button 134 so that shuttle 106 slides across the center of handle assembly 101, engagement tab 144 (which is spring biased into contact with guide rail 148) by the flexed locking arm 142, will eventually align and fall "into" engagement with locking cutout 149. This action will effectively lock the shuttle and the blade into a very safe central location within the knife. As this happens, the locking shoulder 140 will align with and move up into engagement (by the spring bias of the bridge structure 130) with the central widened cutout 176. When locked in this "safe mode", no portion of the blade can be accessed. The user would have to follow the above steps to again release both locking mechanisms to again be able to move the shuttle side to side.

Of course, although TWO safe locking features are preferred here, the above described disposable knife can be provided with only the lateral locking mechanism or the vertical locking mechanism, or neither, depending on the particular intended application or marketing strategy of the knife.

Cover handle half 102 preferably includes a flat section 191 (see FIG. 21) that will allow for advertisement or other information printed on the handle).

The handle thus described in this fourth embodiment and shown in FIGS. 19-31 includes a central "bulge" 190 that allows the user to better grip the handle assembly 101. As is understood by those skilled in the art, rubber overlay or other gripping material may be applied to any portion of the handle assembly 101 to increase the grip by the user.

The handle halves 102, 104 can be made from metal or plastic, but are preferably made from an appropriate strong plastic that can be injection molded.

What is claimed is:

1. A knife comprising:

a blade having first and second cutting edges located at opposite ends of the blade, an elongated handle having two opposing sides and including a cavity, an elongated slot and first and second opposing ends, one side of the handle having a first locking recess located at a first locking point, and a first lock-release button supported by the handle and being accessible to a user, and the handle having a second locking recess located adjacent the slot and at a second locking point;

a shuttle affixed to the blade and slidable within the cavity between the first and second opposing ends, the shuttle including:

a first locking tab that is biased to engage with the first locking recess when the shuttle moves into alignment with the first locking point, and an arm that projects through the slot, the arm being accessible to the user during use of the knife and also being slidable within the slot, the arm being linearly displaceable with respect to the handle between a locked orientation and a released orientation, the arm including a second locking tab sized and shaped to engage with the second locking recess when the arm moves into alignment with the second locking point, and a spring bias that forces the second locking tab towards engagement with the second locking recess when the arm is located at the second locking point, the engagement of the first locking tab with the first locking recess and the engagement of the second locking tab with the second locking recess immobilizes the shuttle and blade with respect to the handle until the first lock-release button and the second lock-release button are simultaneously depressed, depressing the first lock-release button disengages the first locking tab from said first locking recess and depressing the second lock-release button disengages the second locking tab from the second locking recess to allow sliding movement of the blade with respect to the handle;

the location of the first lock-release button being stationary with respect to the handle regardless of the location of the shuttle within the handle;

the first locking tab engages said first locking recess at the same time that the second locking tab engages the second locking recess when the shuttle slides to a point between the two opposing ends and the cutting edges are disposed within the housing.

2. The knife according to claim 1, wherein the cavity is elongated and arcuate so that the shuttle and blade follow a curved path between the first and second ends.

3. The knife according to claim 1, wherein one side of the handle contains the release button.

4. The knife according to claim 1, wherein the handle includes a third locking recess located adjacent the slot and at a third locking point, the second locking tab on the arm sized and shaped to engage the third locking recess when the arm moves into alignment with the third locking point.

5. The knife according to claim 4, wherein the third locking point is located adjacent to the first end of the handle.

6. The knife according to claim 5, wherein said handle includes:

a fourth locking recess located adjacent the slot and at a third locking point, the second locking tab on the arm being sized and shaped to engage a fourth locking recess when the arm moves into alignment with a fourth locking point.

7. The knife according to claim 6, wherein the fourth locking point is adjacent to the second end of said handle.

* * * * *